US007990306B2

(12) United States Patent
Yamamoto et al.

(10) Patent No.: US 7,990,306 B2
(45) Date of Patent: Aug. 2, 2011

(54) RADIO CONTROL TRANSMITTER FOR MODELS

(75) Inventors: Michio Yamamoto, Chiba (JP); Kota Toyotomi, Chiba (JP)

(73) Assignee: Futaba Corporation, Chiba (JP)

( * ) Notice: Subject to any disclaimer, the term of this patent is extended or adjusted under 35 U.S.C. 154(b) by 999 days.

(21) Appl. No.: 11/851,150

(22) Filed: Sep. 6, 2007

(65) Prior Publication Data

US 2008/0238756 A1 Oct. 2, 2008

(30) Foreign Application Priority Data

Sep. 14, 2006 (JP) ..... 2006-248803

(51) Int. Cl.
*H04L 17/02* (2006.01)

(52) U.S. Cl. ..... 341/176; 340/12.5; 455/73; 455/91; 455/95; 446/456; 446/454; 434/29; 434/30; 434/32

(58) Field of Classification Search ..... 341/176; 340/12.5; 446/456, 454; 434/29, 30, 32
See application file for complete search history.

(56) References Cited

U.S. PATENT DOCUMENTS

| | | | | |
|---|---|---|---|---|
| 5,280,634 | A * | 1/1994 | Aneha | 455/95 |
| 5,408,689 | A * | 4/1995 | Aneha | 455/91 |
| 5,461,373 | A * | 10/1995 | Yamamoto et al. | 340/12.5 |
| 6,983,128 | B2 * | 1/2006 | Wright | 455/73 |
| 7,010,628 | B2 * | 3/2006 | Cloud et al. | 710/72 |
| 7,102,561 | B2 * | 9/2006 | Tokita | 341/176 |
| 7,202,806 | B2 * | 4/2007 | Mukaida | 341/176 |

FOREIGN PATENT DOCUMENTS

JP 2000225277 A 8/2000

* cited by examiner

*Primary Examiner* — Albert Wong
(74) *Attorney, Agent, or Firm* — Edell, Shapiro & Finnan, LLC

(57) ABSTRACT

A radio control transmitter for a model is disclosed wherein a control range is limited to not to exceed a maximum control range without using a mechanical means. In accordance with the transmitter, an added control range being a sum of two or more of the control ranges is calculated, whether the added control range exceeds a maximum control range set to correspond to the operating section of the object to be controlled is determined, and the control range is corrected when the added control range exceeds the maximum control range.

4 Claims, 4 Drawing Sheets

<Prior Art>

RADIO CONTROL TRANSMITTER FOR MODELS

CROSS REFERENCE TO RELATED APPLICATIONS

This application claims priority under 35 U.S.C. §119 to Application No. JP2006-248803 filed on Sep. 14, 2006, entitled "Radio Control Transmitter for Models," the entire contents of which are hereby incorporated by reference.

FIELD OF THE INVENTION

The present invention relates to a radio control transmitter for remotely controlling an object to be controlled by controlling a control signal transmitted to the object to be controlled through a radio frequency wave, and in particular to a radio control transmitter suitable for remotely controlling an object to be controlled such as a model plane, a model helicopter, a model car or a model boat.

BACKGROUND

A radio control transmitter for a model controlling an object to be controlled such as a model plane, a model helicopter, a model car or a model boat comprises a stick lever operating a main controller and various levers and switches operating as an auxiliary controller. Each of the stick lever and the various levers is connected to a shaft of a variable resistor. Each of the various switches operates as the auxiliary controller by turning ON and OFF. Each of the stick lever and the various levers is controlled to control a rotational range of the variable resistor, thereby generating multiple control signals that is transmitted from the radio control transmitter as a radio frequency wave. The object to be controlled has a receiver for receiving the control signal and servos for operating an operating section of the object to be controlled. The object is remotely controlled by controlling an operating range of each of the servos based on the control signal received by the receiver.

For instance, when a model helicopter is remotely controlled as the object to be controlled, the model helicopter including a main rotor and a tail rotor is flown with various maneuvers by operating the stick lever of the radio control transmitter for the model to control pitch angles of the two rotors (Japanese Patent Publication 2000-225277 for reference).

In other words, the control of the pitch angle of the main rotors is carried out by controlling a swash plate using the servo wherein the swash plate is disposed concentric with a shaft of the main rotor and has a degree of freedom in three axes.

FIG. 7 illustrates a control manner of the swash plate in the model helicopter (the main rotor is not shown). A control of forward and reverse shown in FIG. 7 (*a*) is referred to as a pitch control (also referred to as an elevator control), a control of left and right shown in FIG. 7 (*b*) is referred to as a roll control (also referred to as an aileron control), and a control of up and down shown in FIG. 7 (*c*) is referred to as a collective pitch control. The helicopter is controlled to a desired direction by combining the controls during a flight.

Specifically, in order to fly the helicopter in a forward direction (a direction of an arrow A) shown in FIG. 7(*a*), a left stick lever 101L of a radio control transmitter 100 is pushed upward (forward) to control a swash plate 120 disposed concentric with a shaft of a main rotor 110 using the servo (not shown) in a manner that the swash plate 120 is tilted in a direction of an arrow a. In order to fly the helicopter in a left direction (a direction of an arrow B) shown in FIG. 7(*b*), the left stick lever 101L of the radio control transmitter 100 is pushed left to control the swash plate 120 disposed concentric with the shaft of the main rotor 110 using the servo (not shown) in a manner that the swash plate 120 is tilted in a direction of an arrow b. In order to fly the helicopter in a upward direction (a direction of an arrow C) shown in FIG. 7(*c*), a right stick lever 101R of the radio control transmitter 100 is pushed upward to control the swash plate 120 disposed concentric with the shaft of the main rotor 110 using the servo (not shown) in a manner that the swash plate 120 is tilted in a direction of an arrow c.

As described above, while the model helicopter is remotely controlled by controlling the swash plate using the servo, controls for moving a fuselage in the forward, reverse, left, right, upward and downward directions are carried out in a combined manner. Therefore, the swash plate is subjected to the combination of the pitch control, the roll control and the collective pitch control.

However, the swash plate disposed concentric with the shaft of the main rotor has a limited maximum control range (maximum slant) at which a control range is maximum due to a mechanical limitation. Therefore, when the pitch control and the roll control perpendicular to each other are carried out simultaneously so that ranges of the pitch control and the roll control are added, a control range of the swash plate is saturated. When the control range of the swash plate is saturated, an excessive load is applied to the servo (the servo for controlling the roll or the pitch) which is an operating source thereof or to a linkage rod connecting the swash plate and the servo.

Therefore, the control range is required to be large because an immediate response of the roll control and the pitch control is necessary in the model helicopter performing an acrobatic flying (three dimensional flying).

Some of the transmitter employs a method wherein the control range of the swash plate is controlled by inserting a ring shape plate referred to as a stopper along an outer edge of the stick lever of the radio control transmitter for the model to mechanically limit the operation of the stick lever.

However, even when the saturation of the swash plate is solved by the stopper which is a mechanical means, a drawback described below still exists.

The controls of the pitch and the roll are carried out by one stick lever or by dividing into left and right stick levers. When the one stick lever is used, the stopper solves the problem. However, when the left and right stick levers are used, the stopper is not sufficient for a normal operation.

SUMMARY

It is an object of the present invention to provide a radio control transmitter for models wherein each of individual control ranges of each of stick levers may be allowed to controlled up to a maximum control range and each of the individual control ranges is limited to maximum control range even when a sum of each of the control ranges exceeds the maximum control range.

In order to achieve the above object of the present invention, there is provided a radio control transmitter for a model generating a control signal for controlling a control range of an operating section of an object to be controlled according to a control of a control means, wherein an added control range being a sum of two or more of the control ranges is calculated, whether the added control range exceeds a maximum control range set to correspond to the operating section of the object to be controlled is determined, and the control range is corrected when the added control range exceeds the maximum control range.

The added control range is a vector sum of the two or more of the control ranges by the control of the control means.

There is also provided a radio control transmitter for a model generating a control signal for controlling a control range of an operating section of a model helicopter to be controlled according to a control of a control means, wherein an added control range being a sum of the control ranges of a pitch and a roll of a swash plate is calculated, and whether the added control range exceeds a maximum control range set to correspond to the swash plate of the model helicopter to be controlled is determined, and the control range is corrected when the added control range exceeds the maximum control range.

There is also provided a radio control transmitter for a model generating a control signal for controlling a control range of an operating section of an object to be controlled according to a control of a control means, the transmitter comprising: an added control range calculating means for calculating an added control range being a sum of two or more of the control ranges; a control range determining means for determining whether the added control range exceeds a maximum control range set to correspond to the operating section of the object to be controlled; and a control range correcting means for correcting the control range when the added control range exceeds the maximum control range.

DETAILED DESCRIPTION

A preferred embodiment of the present invention will now be described in detail with reference to the accompanied drawings.

Figure 1:
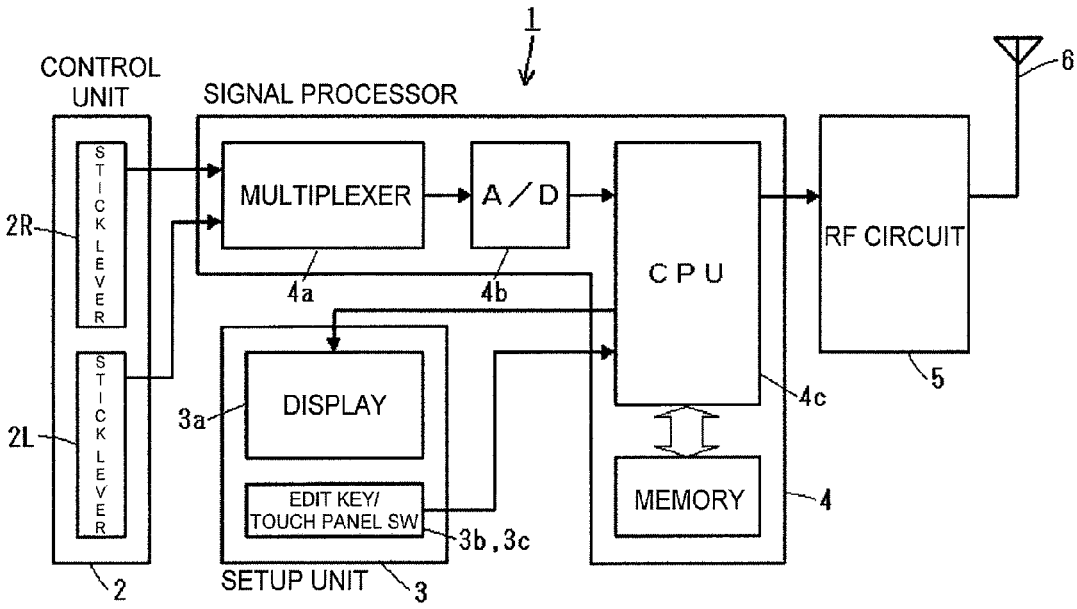
FIG. 1 is a block diagram schematically illustrating a radio control transmitter for a model in accordance with a preferred embodiment of the present invention.

FIG. 1 is a block diagram schematically illustrating a radio control transmitter for a model in accordance with a preferred embodiment of the present invention.

As shown in FIG. 1, a transmitter 1 comprises a control unit 2, a setup unit 3, a signal processor 4, a high frequency circuit 5 and an antenna 6.

The control unit 2 comprises a stick lever 2R and a stick lever 2L. The stick lever 2R and the stick lever 2L outputs an analog signal as a control signal according to a control by shifting in up, down, left and right directions to vary a resistance value of a variable resistor.

The setup unit 3 for setting up or changing a configuration comprises a display 3*a* such as a liquid crystal display and a plurality of edit keys 3*b* disposed in main body of the transmitter 1 or a touch panel switch 3*c* disposed on a display screen of the display 3*a*. Particularly, various configurations are set up by displaying a setup screen on the display screen of the display 3*a* and operating the plurality of edit keys 3*b* or the touch panel switch 3*c* with reference to the setup screen.

The signal processor 4 may be embodied using a one-chip microprocessor for instance, and may include a multiplexer 4*a*, an A/D converter 4*b*, a CPU 4*c* and a memory 4*d*.

The multiplexer 4*a*, which is a multi-contact switch, is switched by an operation of the stick lever 2R and the stick lever 2L and inputs the control signal (the analog signal) being outputted according to the control of the stick lever 2R (or the stick lever 2L) to the A/D converter 4*b*.

The A/D converter 4*b* converts the control signal generated according to the stick lever 2R and the stick lever 2L being inputted from the multiplexer 4*a* into a digital signal to be outputted to the CPU 4*c*.

The CPU 4*c* is embodied by a microprocessor. A signal from the A/D converter 4*b*, a signal from the plurality of edit keys 3*b* or the touch panel switch 3*c* of the setup unit 3 are inputted to the CPU 4*c*. The CPU 4*c* carries out a change of the configuration based on a program stored in the memory 4*d* such as a ROM or a RAM, a control of outputting the control signal based on the control signal by the control of the stick lever 2R and the stick lever 2L, and a correction of a control range in an operating section of an object to be controlled reflected in the control signal. Accordingly, the CPU 4*c* outputs the control signal (a data of each channel) according to the control of the stick lever 2R and the stick lever 2L to the high frequency circuit 5 as a serial signal (the control signal) of a base band having a fixed frame length.

The high frequency circuit 5 modulates (FM for instance) the control signal from the CPU 4*c* into a high frequency signal to be transmitted through the antenna 6 as a radio frequency wave.

In accordance with the transmitter 1 described above, when the stick lever 2R and the stick lever 2L of the transmitter 1 are operated, a signal according to the operation of the stick lever 2R the stick lever 2L and a signal according to the correction in the CPU 4*c* are modulated into the high frequency signal and then transmitted as the radio frequency wave. In a receiver disposed in the object to be controlled, the radio frequency wave from the transmitter 1 is received and demodulated into the data of each channel, a servo is operated according to the demodulated data to control the operating section of the object to be controlled, thereby remotely controlling the object to be controlled.

Accordingly, in accordance with the transmitter of the present invention, when a sum of two or more of the control ranges (added control range) exceeds a maximum control range being set to correspond to the operating section of the object to be controlled, the control range is corrected.

The correction of the control range is described in detail in case of remotely controlling the model helicopter using the transmitter 1 in accordance with the present invention.

Figure 2:
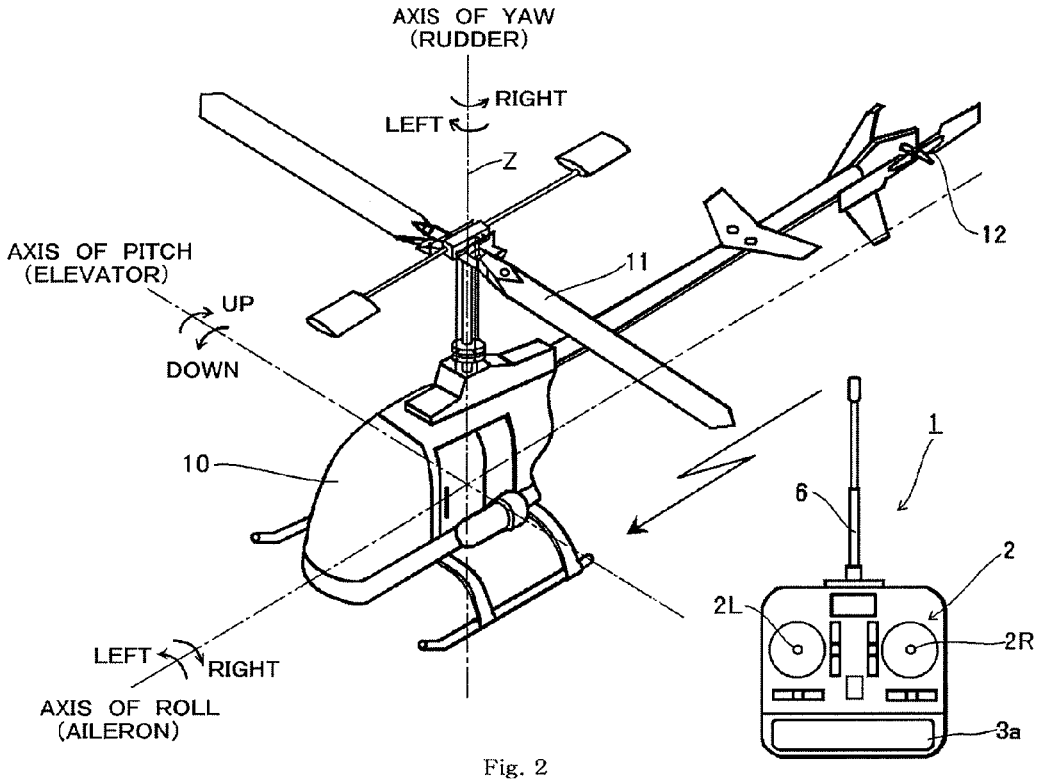
FIG. 2 is a diagram illustrating a model helicopter remotely controlled by a radio control transmitter for a model in accordance with a preferred embodiment of the present invention.

FIG. 2 is a diagram illustrating the model helicopter remotely controlled by the radio control transmitter 1 in accordance with the preferred embodiment of the present invention.

As shown in FIG. 2, the model helicopter includes two rotors, i.e. a main rotor 11 and a tail rotor 12 on a fuselage 10. A pitch angle of each of the two rotors is controlled by operating the stick lever 2R and the stick lever 2L of the transmitter 1 shown in FIGS. 1 and 2 up, down, left and right, thereby remotely controlling the model helicopter. Although not shown, the receiver for receiving the control signal transmitted from the transmitter 1, the servo for driving the operating section of the object to be controlled based on the control signal received by the receiver and a model engine or an electric motor which is a driving source of the model helicopter are mounted in the fuselage 10.

Similar to the prior art, the control of the pitch angle of the main rotor 11 in the model helicopter is carried out by controlling the swash plate.

Figure 3:
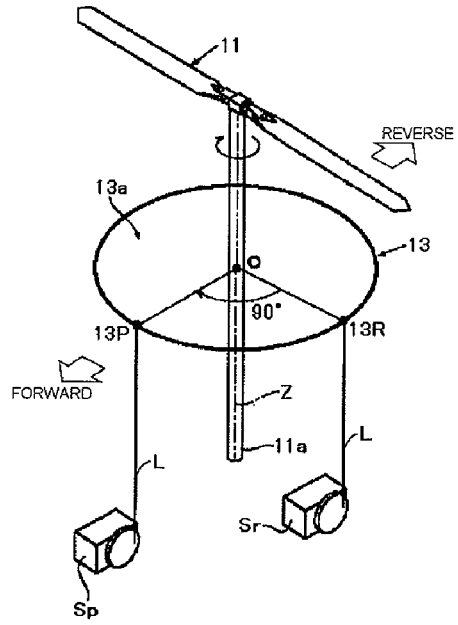
FIG. 3 is a diagram illustrating a control principle of a swash plate.

FIG. 3 is a diagram illustrating a control principle of the swash plate.

The swash plate 13 is disposed concentric with a shaft 11*a* of the main rotor 11 in a manner that a control surface (a surface constituting a basic circle) thereof may be slanted with respect to a center axis of the shaft 11*a* within a mechanically limited range and slide up and down along the shaft 11*a*. Along an outer edge of the swash plate 13, a pitch control point 13P is disposed parallel to forward and reverse directions of the model helicopter and a roll control point 13R is disposed perpendicular to the forward and the reverse directions of the model helicopter. One end of a linkage rod L is connected to each of the pitch control point 13P and the roll control point 13R and the other end is connected to each of servos Sp and Sr.

Therefore, in case of the pitch control, the stick lever 2L of the transmitter 1 is operated up and down to drive the servo Sp for the pitch control. The swash plate 13 is then slanted with respect to a pitch axis, thereby controlling the fuselage to fly in the forward and the reverse directions. In case of the roll control, the stick lever 2L of the transmitter 1 is operated left and right down to drive the servo Sr for the roll control. The swash plate 13 is then slanted with respect to a roll axis, thereby controlling the fuselage to fly in the left and the right directions. In addition, the collective pitch control is carried out by sliding the swash plate 13 up and down using a separate link (not shown) to fly the fuselage up and down.

Figure 4:
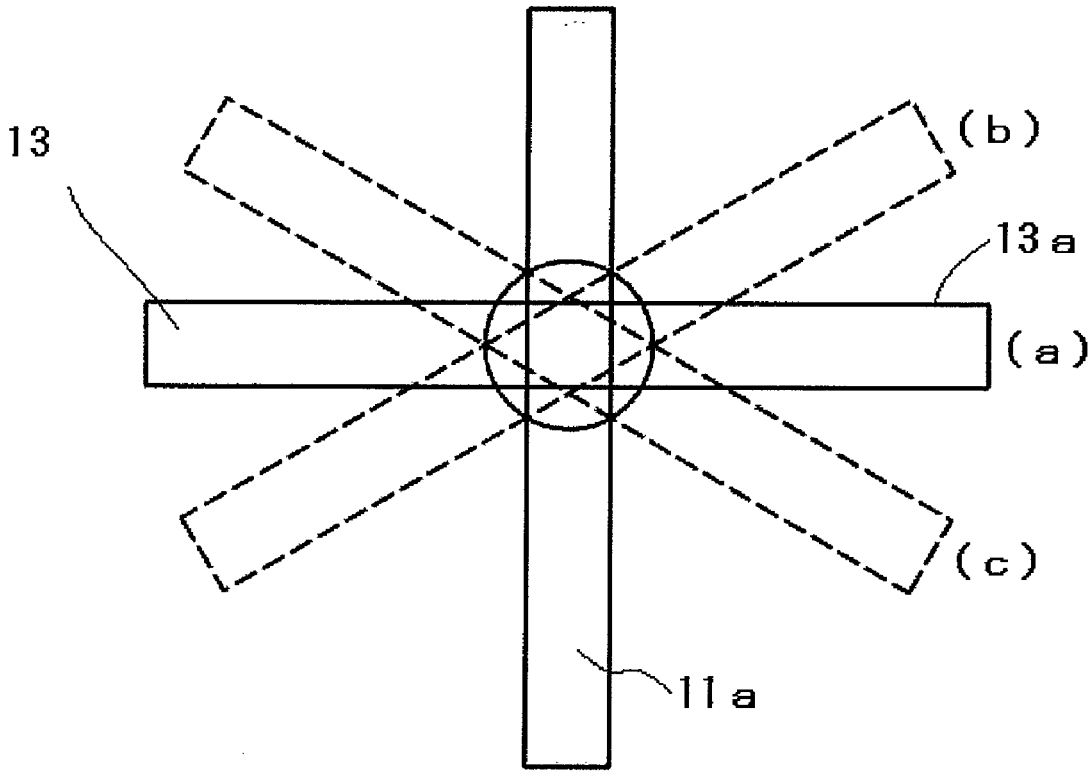
FIG. 4 is a diagram schematically exemplifying an operation of a swash plate.

FIG. 4 is a pattern diagram exemplifying the operation of the swash plate 13 during the roll control.

As shown in FIG. 4, the swash plate 13 is positioned such that the control surface 13*a* of the swash plate 13 is perpendicular to the shaft 11*a* of the main rotor 11 when the roll control is not carried out (denoted as (a) in FIG. 4).

When the roll control is carried out for the fuselage to move left, the control surface 13*a* of the swash plate 13 is slanted left wherein a position denoted by (b) is a position of a maximum control range (a maximum slant). When the roll control is carried out for the fuselage to move right, the control surface 13*a* of the swash plate 13 is slanted right wherein a position denoted by (c) is the position of the maximum control range (the maximum slant). That is, when the roll control is carried out, the swash plate 13 is slanted in a control direction with respect to a horizontal position denoted as (a). In addition, when the pitch control is carried out, the swash plate 13 is slanted in the control direction with respect to the horizontal position denoted as (a). However, the maximum control range which is the maximum slant is limited due to the mechanical limitation of the swash plate 13. Therefore, when the pitch control and the roll control are carried out in combination under a configuration wherein the maximum control range of each of the pitch control and the roll control is set to be the maximum control range of the swash plate 13, the control range of each of the pitch control and the roll control are added to exceed the maximum control range.

Therefore, the transmitter 1 in accordance with the present invention allows each of the control ranges by the operation of the stick levers to be the maximum control range for the pitch control and the roll control, and when the pitch control and the roll control are carried out in combination such that the transmitter 1 corrects the sum of the control ranges to not to exceed the maximum control range when the sum of the control ranges exceeds the maximum control range.

The correction is carried out by setting (1) the control range to be corrected (the control range to be added), and (2) the maximum control range which is a threshold value to be corrected in advance. Accordingly, (1) and (2) are particularly set by operating the plurality of edit keys 3*b* or the touch panel switch 3*c* with reference to the setup screen of the display 3*a* of the transmitter 1.

Figure 5:
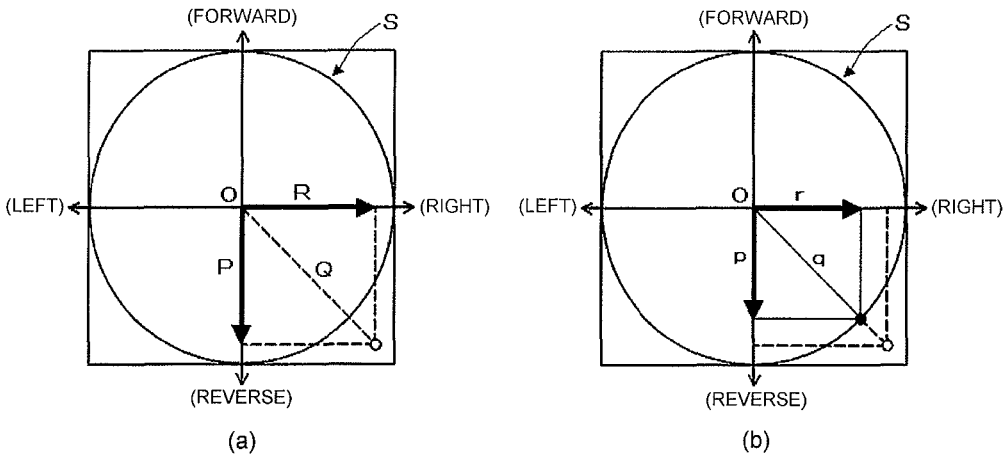
FIG. 5 is a diagram illustrating a relationship between a control range, an added control range and a corrected control range of a swash plate.

FIG. 5 is a diagram illustrating a relationship between the control range (an amount of the slant), the added control range and the corrected control range of the swash plate in order to correct the control range based on the setting.

FIG. 5 depicts the control range of the swash plate as a vector based on the control direction (a direction of the slant) and the amount of the slant (slant angle) with respect to a center 0 of the swash plate.

In FIG. 5, the maximum control range S of the swash plate which makes the control range (the amount of the slant) thereof maximum due to the mechanical limitation of the swash plate is depicted as a circle, and the added control range by the roll control and the pitch control is depicted as a square.

As shown in FIG. 5(*a*), when R in the right direction is the control range by the roll control of the swash plate and P in the reverse direction is the control range by the pitch control of the swash plate, the added control range Q of the swash plate by the two control range, which is a vector sum of the two control range, may be expressed as equation 1.

$$Q = \sqrt{P^2 + Q^2} \qquad \text{[Equation 1]}$$

Therefore, the added control range Q of the swash plate obtained form equation 1 may be depicted as a white dot. The added control range Q substantially exceed the maximum control range S of the swash plate. In accordance with the transmitter of the present invention corrects the added control range Q down to the maximum control range S. The correction is carried out to be proportional to the roll control and the pitch control. When r is the corrected control range of the roll control and p is the corrected control range of the pitch control, the corrected added control range may be obtained from equation 2.

$$p=P\times(S/Q), r=R\times(S/Q) \qquad \text{[Equation 2]}$$

As a result of the correction of the equation 2, the corrected added control range q corresponds with the maximum control range S represented by a black dot.

Therefore, a special operation during the operation of the stick lever is not required for the operator because the correction is carried out by the CPU executing a program stored in the memory.

Figure 6:
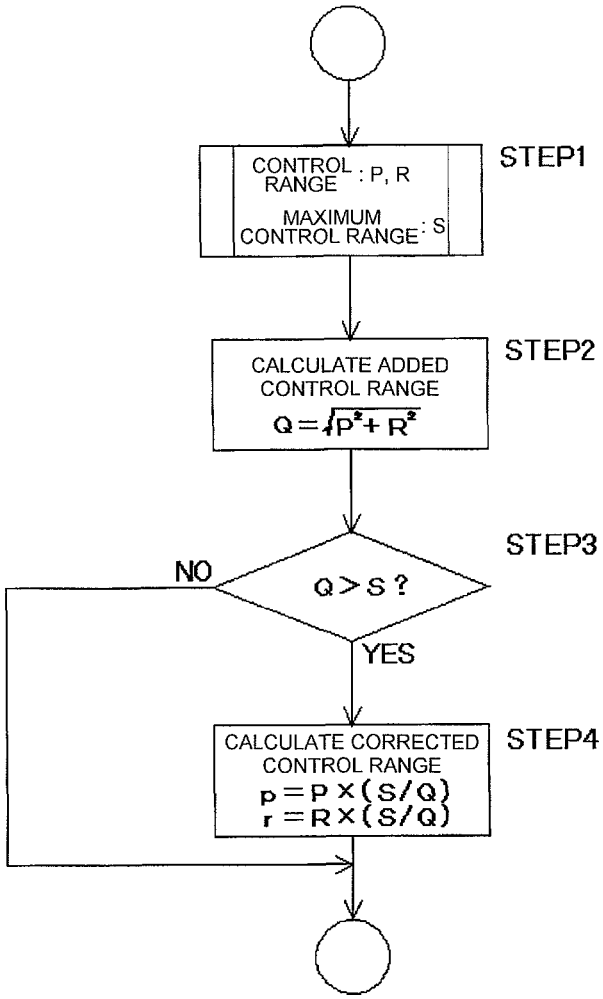
FIG. 6 is a flow diagram illustrating an order of a correction in a CPU in a radio control transmitter for a model in accordance with a preferred embodiment of the present invention.
Figure 7:
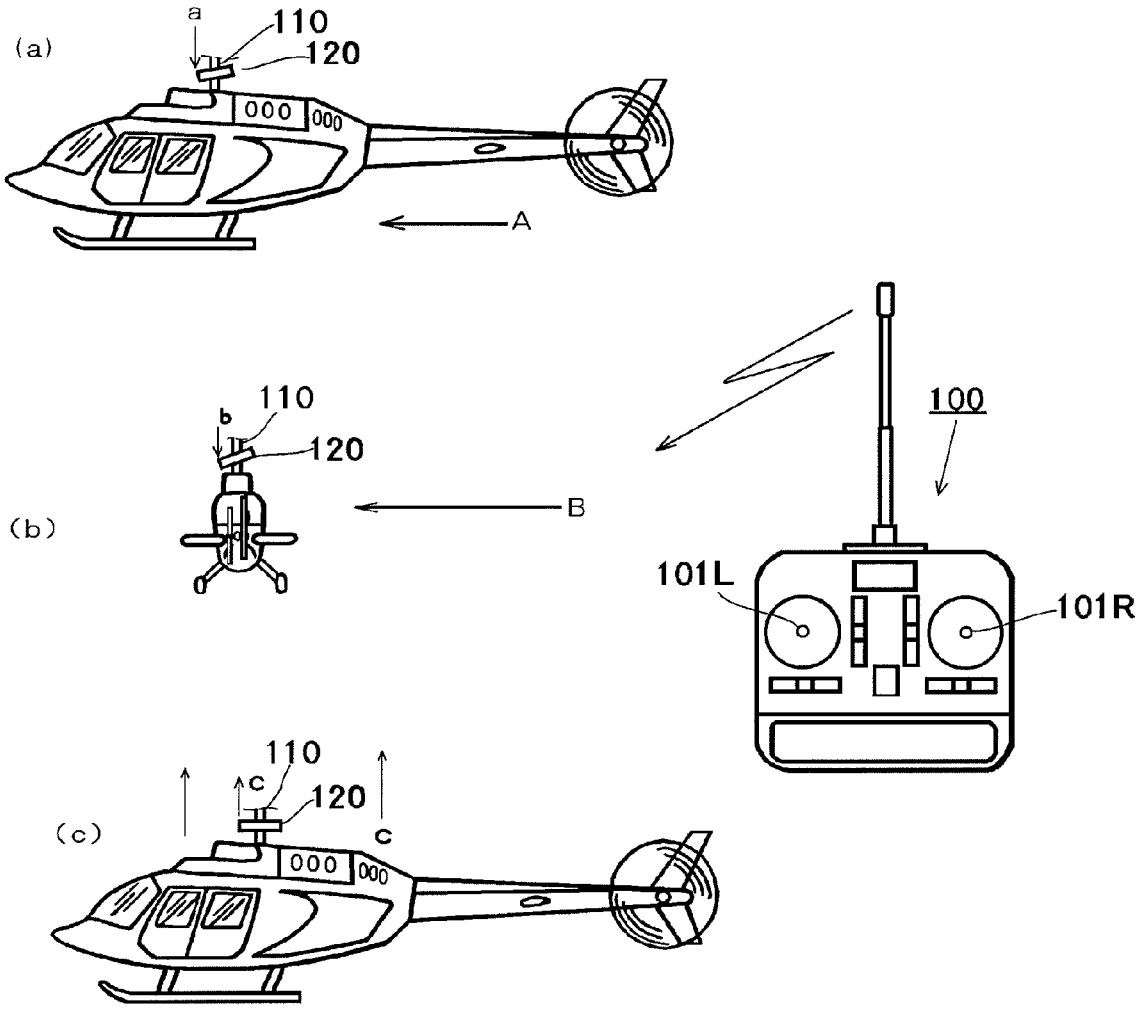
FIG. 7 is a diagram illustrating a control manner of a swash plate in a model helicopter.

FIG. 6 is a flow diagram illustrating an order of a correction in the CPU in the radio control transmitter for the model in accordance with the preferred embodiment of the present invention.

When the stick lever of the transmitter is operated by the operator to input the control signal to the CPU and the flow diagram shown in FIG. 6 is started, the pitch control range P, the roll control range R and the maximum control range S which are set as the control range to be added (or corrected) in advance are read in STEP 1. The added control range Q by pitch control range P and the roll control range R which are read in step1 is calculated in STEP2. In STEP3, whether the added control range Q calculated in STEP2 is larger than the maximum control range S is determined. When the added control range Q is determined to be larger than the maximum control range S (STEP3-YES), each corrected control range is calculated in the STEP4. When the added control range Q is determined to be no larger than the maximum control range S (STEP3-NO), STEP3 is terminated.

As described above, the radio control transmitter for the model in accordance with the present invention allows each of the control ranges by the operation of the stick levers to be the maximum control range for the pitch control and the roll control, and when the pitch control and the roll control are carried out in combination to exceed the maximum control range, each of the control range are corrected such that the sum of the control ranges does not to exceed the maximum control range. Therefore, an excessive load is not applied to the operating section of the object to controlled related to the control (the swash plate when the object to be controlled is the model helicopter for instance), the servo for driving the operating section or the linkage rod connecting the swash plate and the servo, thereby preventing a damage thereof.

While the present invention has been particularly shown and described with reference to the preferred embodiment and drawings thereof, it will be understood by those skilled in the art that various changes in form and details may be effected therein without departing from the spirit and scope of the invention as defined by the appended claims.

For instance, while the corrected control range according to the correction of the preferred embodiment is calculated by a similar calculation, the method for calculating the corrected control range is not limited to the similar calculation. For instance, a ratio of the correction for the roll control and the pitch control may be changed such that one of the roll control and the pitch control may be primarily corrected. A same effect is obtained for such instance.

Moreover, while the embodiment wherein a T type swash plate having the control points disposed in every 90 degrees is described, the present invention may be applied to other swash plate such as Y type swash plate having the control points disposed in every 120 degrees. That is, while a particular control differs according to the type of the swash plate, the present invention may be applied to the swash plate of different types since the control range of the operating section of the object to be controlled is corrected.

While the description of the embodiment is focused on the transmitter of the present invention for controlling the model helicopter, the transmitter of the present invention may be applied to other models.

What is claimed is:

1. A radio control transmitter for a model generating a control signal for controlling a control range of an operating section of an object to be controlled according to a control of a control means, wherein an added control range being a sum of two or more of the control ranges is calculated, whether the added control range exceeds a maximum control range set to correspond to the operating section of the object to be controlled is determined, and the control range is corrected when the added control range exceeds the maximum control range.

2. The transmitter in accordance with claim 1, wherein the added control range is a vector sum of the two or more of the control ranges by the control of the control means.

3. A radio control transmitter for a model generating a control signal for controlling a control range of an operating section of a model helicopter to be controlled according to a control of a control means, wherein an added control range being a sum of the control ranges of a pitch and a roll of a swash plate is calculated, and whether the added control range exceeds a maximum control range set to correspond to the swash plate of the model helicopter to be controlled is determined, and the control range is corrected when the added control range exceeds the maximum control range.

4. A radio control transmitter for a model generating a control signal for controlling a control range of an operating section of an object to be controlled according to a control of a control means, the transmitter comprising:

an added control range calculating means for calculating an added control range being a sum of two or more of the control ranges;

a control range determining means for determining whether the added control range exceeds a maximum control range set to correspond to the operating section of the object to be controlled; and a control range correcting means for correcting the control range when the added control range exceeds the maximum control range.

* * * * *